US005716557A

United States Patent [19]

Strauss et al.

[11] Patent Number: 5,716,557

[45] Date of Patent: Feb. 10, 1998

[54] METHOD OF MAKING HIGH ENERGY EXPLOSIVES AND PROPELLANTS

[75] Inventors: Bernard Strauss, Rockaway; Thelma Manning, Montville; Joseph P. Prezelski, Budd Lake; Sam Moy, Parsippany, all of N.J.

[73] Assignee: The United States of America as represented by the Secretary of the Army, Washington, D.C.

[21] Appl. No.: 744,390

[22] Filed: Nov. 7, 1996

[51] Int. Cl.[6] ..... C06B 21/00

[52] U.S. Cl. ..... 264/3.3; 264/3.1; 149/18; 149/19.6; 149/19.92

[58] Field of Search ..... 264/3.1, 3.3; 149/18, 149/19.6, 19.92

[56] References Cited

U.S. PATENT DOCUMENTS

| | | | |
|---|---|---|---|
| 4,325,759 | 4/1982 | Voigt et al. | 149/19.92 |
| 4,976,794 | 12/1990 | Biddle et al. | 149/195 |
| 5,210,153 | 5/1993 | Manser et al. | 149/19.6 |
| 5,529,649 | 6/1996 | Lund et al. | 149/19.6 |
| 5,540,794 | 7/1996 | Willer et al. | 149/19.8 |
| 5,565,150 | 10/1996 | Dillehay et al. | 264/3.3 |
| 5,580,988 | 12/1996 | Dave | 548/953 |
| 5,587,553 | 12/1996 | Braithwaite et al. | 264/3.1 |

*Primary Examiner*—Edward A. Miller

*Attorney, Agent, or Firm*—John F. Morgan; John Callaghan

[57] ABSTRACT

A method of formulating high energy explosives and propellants, including the steps of melting the explosive at a temperature just above its melting temperature, admixing and dissolving or plasticizing a binder, and extruding or casting the resultant solution into a useful form for further forming the resulting material into a munitions. The first step in this method includes the use of any high energy explosive material. Examples of these include hexanitrohexaazaisowurtzitane or CL-20, 1,3,3-trinitroazetidine or TNAZ, 2,4,6-trinitrotoluene or S-TNT, 1,3,5-trinitrobenzene or S-TNB, HMX, RDX, butane-trio-trinitrate or BTTN, trimethylolethane trinitrate or TMETN; triethylene glycol dinitrate or TEGDN, bis, 2,2-dinitro propyl acetal/bis 2,2 dinitro propyl formal or BDNPA/F, methyl nitrato ethyl nitramine or methyl NENA, ethyl NENA, mixtures thereof and the like. Binders that are useful for the present invention include cellulose acetate butyrate, ethyl centralite, oxetane thermoplastic elastomers, nitrocellulose, HYTREL and ESTANE polymers, and the like.

7 Claims, No Drawings

METHOD OF MAKING HIGH ENERGY EXPLOSIVES AND PROPELLANTS

The invention described herein may be manufactured, used, and licensed by or for the U.S. Government for U.S. Governmental purposes.

FIELD OF THE INVENTION

The present invention relates generally to a method of making high energy explosives and propellants. More particularly the invention relates to a method in which high energy explosives and fillers are combined with binders and the like which produce a superior product with improved properties.

BACKGROUND OF THE INVENTION

As with the evolution of many technologies, new weapon systems require higher munitions performance. Current standard propellants do not have adequate energy to deliver the performance required for systems that are presently being developed. JA2, which is a standard double base propellant used, for example, in the M829A1 and M829A2 tanks rounds, has an impetus value of 1150 Joules/gram or J/g. M43, which is used in the M900A1 cartridge, has an impetus of 1181 J/g. Both of these conventional propellants do not have the energy level to deliver the muzzle velocity required in future high energy tank systems such as the M829E3. Theoretical calculations have shown that a propellant containing an energy above the 1300 J/g threshold is needed.

In addition to the energy content, it has been shown by theoretical calculations that the ballistic cycle can be optimized and work output can be maximized by using a combination of two equienergetic propellants whose burning rates are different by a factor of three or four. The slow burning propellant is designed to enter the cycle at a later time. Current standard propellants do not exhibit such wide variation in burning rates at a specified energy level. Standard tank gun propellants such as XM39, M43, M44 or JA2 have burning rate differentials that are, at best, less than two to one, and thus they are unsatisfactory for solving the problem of delivering much higher muzzle velocities.

Along with the inability to generate adequate energy levels, present day propellants produce volatile organic compounds and ancillary waste, especially in enhanced demil and recyclability. To meet the environmental requirements of the Environmental Protection Agency to reduce the emission of solvents into the atmosphere, the propellant binder must be extruded under non-solvent processing methods.

The next generation military explosive, 1,3,3-Trinitroazetidine or TNAZ, is somewhat brittle when formulated into pressed billets of pure TNAZ. In addition, mechanical strength of the explosive is not as high as would be desirable, particularly when the material is being extruded into cartridge formulations. It would be a great advance in the art if improved formulations using TNAZ were to be discovered. It is particularly important to improve the amount of acceleration required to fracture cast TNAZ if it is to take its place as a desirable explosive.

Even TNAZ is not as high in energy content as combination formulations that have been conceived but not tested in the field due to difficulties in formulation. It has not been possible to formulate explosives with small quantities of other explosives such as 2,4,6-trinitrotoluene or S-TNT and 1,3,5-trinitrobenzene or S-TNB, RDX and HMX into TNAZ and achieve adequate dispersion of the minor quantity within the larger explosive. A way of properly dispersing these materials is needed.

It would be a great advance in the explosive art if a method of formulating explosives and propellants could be provided that would permit casting of high energy materials such as TNAZ, CL-20, and the energetic thermoplastic elastomers, in which the product produced by this method would be significantly less sensitive to impact.

Finally, it has been known that explosives are optimized when they are press loaded to a theoretical maximum density or TMD, even though the formulations do not always require 100% of TMD. It would be an advantage to have a method of producing such without significant difficulties or problems in processing.

Accordingly, one object of the present invention is to provide a method of formulating high energy explosives and propellants.

Another object of this invention is to provide a method of incorporating two or more high energy explosives and propellants whose burning rate are dissimilar.

An additional object of this invention is to provide new method of formulating energetic materials that eliminate or greatly reduce both volatile organic compound production and ancillary waste through demil and recyclability.

Still another object of this invention is to provide a method of incorporating TNAZ and other new generation materials in explosives and propellants to optimize the properties of the resulting product.

Other objects will appear hereinafter.

SUMMARY OF THE INVENTION

It has now been discovered that the above and other objects of the present invention may be accomplished in the following manner. Specifically it has been discovered that explosives and propellants of high energy may be formulated with other materials that assist in improving the properties of the final product.

The method comprises the steps of melting the explosive or propellant at a temperature slightly above its individual melting point, normally about 10°–20° C. above the melting temperature. A binder is then added to the molten explosive and the mixture is stirred sufficiently to completely dissolve and/or plasticize the binder. The molten solution is then reduced to a usable form, either by extrusion or melt casting into desired propellant shapes so that the cooled crystalline explosive product may then be processed in a conventional manner to fill the cartridge or other projectile.

The term explosive is used herein to encompass high energy explosives and high energy propellants, as these terms are used to describe the same material used in slightly different end uses. The only requirement of the explosive is that it be high energy, capable of being melted to a molten state at a temperature slightly above its melting point without igniting, and that it be compatible with the binders and other materials selected.

Similarly, the binder is used herein to describe a family of materials that are compatible with high energy explosives in that the binder must dissolve or plasticize in the molten explosive so that, upon cooling, the explosive crystallizes and forms discrete particles throughout the extruded or cast and now cooled product. This permits the cooled product to be processed in a variety of ways to prepare the explosive material for use in its intended environment.

As is known, tank gun projectiles have the highest energy and highest temperature. Other projectiles for field use as well as those on aircraft and the like have less energy, as defined by the specific requirements of the armament or munitions being manufactured. It is possible to use the method of this invention to produce explosive or propellants for virtually any such presently existing or planned product. It is intended that the present invention method may be used with a variety of combinations and sub combinations of materials.

DETAILED DESCRIPTION OF THE PREFERRED EMBODIMENT

The present invention has many advantages over the prior art explosive and propellant formulation methods. In its simplest form, the invention comprises the steps of: melting the explosive at a temperature just above its melting temperature, admixing and dissolving or plasticizing a binder, extruding or casting the resultant solution and forming the resulting material into a munitions.

The explosive that is melted as the first step in this method includes any high energy explosive material. Examples of these include hexanitrohexaazaisowurtzitane or CL-20, 1,3,3-trinitroazetidine or TNAZ, 2,4,6-trinitrotoluene or S-TNT, 1,3,5-trinitrobenzene or S-TNB, HMX, RDX, butane-triotrinitrate or BTTN, trimethylolethane trinitrate or TMETN; triethylene glycol dinitrate or TEGDN, bis, 2,2-dinitro propyl acetal/bis 2,2-dinitro propyl formal or BDNPA/F, methyl nitrato ethyl nitramine or methyl NENA, ethyl NENA, mixtures thereof and the like.

Binders that are useful for the present invention include cellulose acetate butyrate, ethyl centralite, oxetane thermoplastic elastomers, nitrocellulose, HYTREL and ESTANE polymers, and the like.

In order to demonstrate the effectiveness of the method of this invention, the following examples were prepared.

EXAMPLE I

One particular combination of explosive and binder that may be prepared using the method of this invention employs an explosive selected from TNAZ, CL-20 and RDX used with an Oxetane thermoplastic elastomer binder or BAMO/AMMO. It is capable of being melted at elevated temperatures to allow the binder to be processable with other propellant ingredients without the use of solvents, and this is a major advantage. BAMO/AMMO is also energetic and is melted at moderate elevated temperature and then solidified into an elastomeric material. It is made from two types of monomers: 3,3-bis-azidomethyl-oxetane, or BAMO as a hard block, and 3-azidomethyl-3-methyloxetane, or AMMO as a soft block. The Oxetane thermoplastic elastomer energetic binder is available from Thiokol Corporation.

Presented below in Table I are examples of explosive materials formed by the method of this invention using Oxetane as the binder. In some examples, the explosive includes a second component, further illustrating the advantages of the present invention. The formulated samples were then tested for Impetus, and it was noted that all samples had an impetus of about 1300 J/g or more.

TABLE I

| Sample | Explosive/parts | Oxetane/parts | Impetus, J/g |
|---|---|---|---|
| A | CL-20/76 | 24 | 1297 |
| B | TNAZ/76 | 24 | 1309 |
| C | TNAZ/76* | 20 | 1335 |

TABLE I-continued

| Sample | Explosive/parts | Oxetane/parts | Impetus, J/g |
|---|---|---|---|
| D | CL20/76* | 20 | 1324 |
| E | RDX/80** | 13.3 | 1319 |
| F | RDX/76*** | 18 | 1306 |
| G | CL20**** | 20 | 1348 |

*Sample also include 4% BDNPA/F
**Sample also included 6.7% BDNPA/F
***Sample also include 6% TNAZ
****Sample also included 4% TNAZ In addition, these explosives with an oxetane thermoplastic elastomer energetic binder has excellent mechanical properties that are superior to conventional propellants because of elastomeric characteristics, especially at cold temperatures such as −20° to −40° F. This binder also has good mechanical properties that are important for uniform ballistic performance as well as having low vulnerability to shaped charge jet impact.

Each of the above batches was formulated into a propellant by mixing in accordance with the method of this invention, followed by extruding at a lower temperature. Selection and control of the precise extrusion parameters was important to obtain proper grain dimensions without excessive swelling or deformation. Table II below identifies the barrel temperature, die temperature and ram speed for each sample batch.

TABLE II

| Sample | Barrel temp., °C. | Die temp. °C. | Ram speed, in/min. |
|---|---|---|---|
| A | 82 | 70 | 0.14 |
| B | 95 | 86 | 0.14 |
| C | 89 | 82 | 0.06 |
| D | 87 | 78 | 0.03 |
| E | 100 | 91 | 0.14 |
| F | 100 | 85 | 0.08 |
| G | 66 | 55 | 0.04 |

To complete the evaluation of the samples, some mechanical behavior tests were performed, the results of which are below in Table III. Tests were done on an Instron test machine at low strain. The symbols for the failure data in the last column of Table III are as follows: B=barrel, P=pancake, SC=slight crumble, and S=split

TABLE III

| Sample | Stress (psi) | % elong (@ max stress) | Modulus, (psi) | Fail Modulus (psi) | Failure Mode |
|---|---|---|---|---|---|
| A | 1780 | 36.7 | 7650 | 742 | B |
| B | 1260 | 26.2 | 8370 | 2480 | B |
| C | 412 | 22.8 | 3160 | 1280 | B, P |
| D | 641 | 30.4 | 3190 | 456 | B, P |
| E | 555 | 16.5 | 6220 | 2870 | P, SC |
| F | 1970 | 18.8 | 18,800 | 5760 | P, S |
| G | 1680 | 30.8 | 8860 | 2860 | P |

EXAMPLE II

Nitrocellulose itself has been used as a binder, using solvents and plasticizers to colloid the nitrocellulose into a dough like consistency during mixing. The solvents are later removed from the propellant to form a solid propellant. In the present invention, however, it has been found that the use of an oxetane thermoplastic elastomer or other secondary binder as described below permits the use of nitrocellulose without the use of solvents that later must be removed. Elimination of solvents such as ethyl alcohol, ethyl acetate and the like is a major advantage of the present invention. When nitrocellulose is used, some ethyl centralite or EC may also be incorporated as a stabilizer.

In order to demonstrate the effectiveness of the propellants of this invention, a number of gun propellant formulations were mixed and extruded. Presented below in Table II are four formulations that have been prepared. All values for the composition are given in percent by weight, based on the total weight.

TABLE IV

| Sample | explosive | nitrocellulose | stabilizer | plasticizer |
|---|---|---|---|---|
| H | CL-20 | 13.15 | EC | BTTN/Oxetane** |
| I | TNAZ | 13.15 | EC | BTTN/Oxetane** |
| J | CL-20* | 13.15 | EC | BTTN/Oxetane** |
| K | TNAZ | 13.15 | EC | BTTN/Oxetane** |

*TNAZ was added as a second oxidizer and also as a plasticizer
**use of solventless method eliminates need for oxetane Each of the above batches was formulated into a propellant by mixing and then extruding. The formulations were then tested for various properties to demonstrate the efficacy of the present invention. Specifically, impact, differential thermal analysis (DTA), and electrostatic and friction sensitivity characteristics. The results show that impact sensitivities are similar to the conventional propellant M43, and that the products of this invention are quite thermally stable. A negative annotation for electrostatic sensitivity indicates no reaction to a 12 Joule electrostatic charge while a negative friction value is for a test with a 60 pound weight.

EXAMPLE III

The method of the present invention has been found to be particularly effective when the explosive is TNAZ and the binder is powdered cellulose acetate butyrate or CAB. It has been found that the powdered CAB becomes completely dissolved and/or plasticized by the liquid explosive. Several batches were prepared and, upon cooling, the structure was examined. In each case, the crystal structure of the solidified explosive samples that included CAB had a finer or smaller crystal structure than that of the pure TNAZ. For that reason, it is believed, the mechanical strength of the explosive/binder mixture is higher than that of the pure high explosive.

In one experiment, mechanical strength was measured by comparing a formulation comprising TNAZ/CAB made by the method of this invention and having a weight percent of 97% and 3%, respectively, to a pure cast TNAZ formulation. The results are presented below in Table V. As can be easily seen, the mechanical strength of the explosive of this invention is more than twice as strong when subjected to high acceleration.

TABLE V

| Sample | TNAZ, % | CAB, % | fracture acceleration, g's |
|---|---|---|---|
| L | 100 | 0 | 35,000 |
| M | 97 | 3 | 75,000 |

A number of other high explosives have been incorporated into the present invention as second explosive. The method of this invention includes the step of gradually introducing other such energetic materials at a temperature of about 115° C. provides for very uniformly distributed second explosives in the primary matrix that is formed during the melt mixing step. To demonstrate this step, an experiment was performed in which 60% by weight of the explosive HMX was added to a melted combination of TNAZ and CAB in a 97%/3% weight ration. The admixture was easily made and the distribution was complete and uniform throughout.

One property that the explosives prepared by the present invention possess is an improved sensitivity to impact. A series of samples were prepared according to the method of this invention, and those samples are presented below in Table VI. The melt cast samples were ground with a Wiley mill to pass through a USS#20 mesh screen. Also shown in Table II below is the impact value in centimeters, with a plus/minus variation for each sample. In some examples a binder has also been added.

TABLE VI

| Sample | TNAZ, % | CAB, % | Other Binder, % | Impact, cm. |
|---|---|---|---|---|
| N | 100[a] | 0 | 0 | 21.58 +/− 1.06 |
| O | 100 | 0 | 0 | 22.55 +/− 1.04 |
| P | 97 | 3 | 0 | 29.40 +/− 1.80 |
| Q | 98 | 2 | 0 | 24.65 +/− 0.65 |
| R | 99 | 1 | 0 | 24.89 +/− 0.55 |
| S | 99.5 | 0.5 | 0 | 26.56 +/− 0.34 |
| T | 90 | 2 | 8[b] | 42.10 +/− 1.50 |
| U | 95 | 1 | 4[b] | 38.50 +/− 1.70 |
| V | 90 | 2 | 8[c] | 43.20 +/− 1.50 |
| W | 95 | 1 | 4[c] | 37.70 +/− 1.80 |
| X | 96 | 0 | 4[c] | 29.41 +/− 0.35 |
| Y | 90 | 2 | 8[d] | 48.50 +/− 1.40 |
| Z | 95 | 1 | 4[d] | 38.50 +/− 0.70 |
| AA | 96 | 0 | 4[d] | 26.26 +/− 1.83 |

[a]= dried powder TNAZ, whereas the other data is from TNAZ or mixture that have been cast and ground.
[b]= BAMO/AMMO binder
[c]= HYTREL binder
[d]= ESTANE binder As can be seen, the present invention provides substantial improvement in impact values, showing that they are substantially less sensitive to impact when compared to a baseline of pure cast TNAZ.

In addition to the increased strength of mechanical properties and decrease in impact sensitivity, the TNAZ formulations also exhibit another desirable property that further substantiates the importance of the present invention. This property permits the formulations to be either cast loaded or press loaded into munitions, and this is important because there are a variety of munitions that will be improved by the explosives of this invention. A pressure density study was conducted on three TNAZ/CAB formulations using a ⅜ inch diameter die set. Since it has been known/hat TNAZ may be press loaded to its theoretical maximum density, pure TNAZ was used as a control during this study. The results are presented below in Table VII, and these results clearly show that all of the TNAZ/CAB formulations pressed to a higher percent of theoretical maximum density in the ⅜ inch tooling for these examples. From this it is extrapolated that the TNAZ/CAB formulations ultimately selected for use in explosives and the like will achieve their maximum TMD when they are press loaded under optimum conditions.

TABLE VII

| Sample Pressure | | Percent TMD Achieved at | | |
|---|---|---|---|---|
| TNAZ/CAB | Press temp., °C. | 25 ksi | 28 ksi | 30 ksi |
| 98:2 | 160 | 95.00 | 96.31 | 96.48 |
| 98:2 | 120 | 94.61 | 95.71 | 96.31 |
| 99:1 | 160 | 96.17 | 96.17 | 96.17 |
| 99:1 | 120 | 94.31 | 94.97 | 95.08 |
| 99/0/5 | 169 | 95.09 | 95.09 | 95.91 |
| 99/0/5 | 120 | 94.60 | 95.04 | 94.93 |
| TNAZ | 160 | 92.23 | 94.40 | 95.05 |
| TNAZ | 120 | 91.30 | 95.59 | 95.16 |

In almost every case, the explosive formulation of the present invention has a pressure density as high or higher than pure TNAZ. This supports the finding that course material seems to press to a higher percent of TMD than fine material.

As can be seen, the method of this invention may be used in a wide variety of systems to produce munitions of superior qualities. The amount of binder will, of course, depend upon the specific needs of the final product design. Amounts of binder may range from as much as 30% to 40% by weight of the total composition, and may be as little as 0.5% or 1.0% or less. As noted above, many other additional components may be added, depending upon the end use for the composition thus formed. Multiple explosives and binders may be used, as long as the mixture of explosives is stable at the melting temperature used and as long as the binder is compatible with all of the explosives.

While particular embodiments of the present invention have been illustrated and described herein, it is not intended that these illustrations and descriptions limit the invention. Changes and modifications may be made herein without departing from the scope and spirit of the following claims.

We claim:

1. An improved method for the preparation of high energy explosive and propellant compositions which contain TNAZ and an energetic, oxetane thermoplastic elastomer and which have an impetus value of at least about 1300 Joules/gram, said method having a first step of melting the TNAZ at a temperature of about 10–20 degrees C above its normal melting point, a second step of adding the elastomer to melt and dissolve in the TNAZ and to form a molten solution and a third step of cooling the solution to a solid form.

2. The method of claim 1 wherein the elastomer includes a hard block prepared from 3,3-bis-azidomethyl-oxetane and a soft block prepared from 3-azidomethyl-3-methyloxetane.

3. The method of claim 1 where the second step includes the addition of nitrecellulose, ethyl centralite and BTTN to the TNAZ and elastomer.

4. The method of claim 1 where the second step includes the addition of CAB to the TNAZ and clastomer.

5. The method of claim 1 where the second step includes the addition of BDNPA/F to the mixture of TNAZ and elastomer.

6. The method of claim 1 where the third step includes casting while cooling the solution to a solid form.

7. The method of claim 1 where the third step includes extrusion while cooling the solution to a solid form.

* * * * *